United States Patent [19]

Vork

[11] 4,173,418

[45] Nov. 6, 1979

[54] APPARATUS FOR MIXING LIQUIDS

[75] Inventor: William D. Vork, Edina, Minn.

[73] Assignee: Graco Inc., Minneapolis, Minn.

[21] Appl. No.: 920,457

[22] Filed: Jun. 29, 1978

[51] Int. Cl.[2] ..... B01F 11/00

[52] U.S. Cl. ..... 366/128; 366/110; 366/209; 366/212; 366/605

[58] Field of Search ..... 366/128, 108, 110, 111, 366/114, 112, 208, 209, 210, 211, 219, 235, 605, 212, 215, 216

[56] References Cited

U.S. PATENT DOCUMENTS

| | | | |
|---|---|---|---|
| 1,831,888 | 11/1931 | Skillman | 366/211 |
| 1,908,561 | 5/1933 | Schletz et al. | 366/211 |
| 2,022,526 | 11/1935 | Schletz | 366/211 |
| 2,520,556 | 8/1950 | Massey | 366/209 |
| 2,527,556 | 10/1950 | Kost | 366/209 |
| 3,339,316 | 9/1967 | Rampe | 366/110 X |
| 3,346,241 | 10/1967 | Schubert | 366/209 |
| 3,388,895 | 6/1968 | Ogren et al. | 366/210 |
| 3,430,926 | 3/1969 | Freedman et al. | 366/212 |
| 3,464,675 | 9/1969 | Fabrize | 366/210 |
| 3,735,962 | 5/1973 | Pagano | 366/605 X |
| 3,981,488 | 9/1976 | Ratowsky | 366/219 |
| 4,045,918 | 9/1977 | Freedman | 366/235 X |

*Primary Examiner*—Stanley N. Gilreath
*Attorney, Agent, or Firm*—Paul L. Sjoquist

[57] ABSTRACT

Apparatus for mixing liquids such as paints in closed containers, including a motor drive unit coupled to a drive pulley to produce a constant rotational speed. The drive pulley is connected via an eccentric crank to a shaker plate which has mounted therein a container housing, the shaker plate being also supported from at least two other points by similar crank couplings so as to produce a circular oscillating motion when the drive motor is actuated.

19 Claims, 4 Drawing Figures

APPARATUS FOR MIXING LIQUIDS

BACKGROUND OF THE INVENTION

The present invention relates to an apparatus for mixing liquids, and particularly an apparatus for mixing paints in closed containers.

In the prior art, a number of techniques have been utilized for physically shaking a paint container in order to obtain a homogeneous, uniform color paint where the pigment has separated from the vehicle or where it is desired to mix a primary pigment paint color with a base paint. These devices generally operate on the principal of shaking the container in an oscillatory manner about the paint container axis, or about an axis which is normal to the paint container axis. However, paint mixers have been devised which utilize various mechanisms to impart a vigorous shaking motion to the paint container utilizing a variety of techniques.

For example, U.S. Pat. No. 3,464,675, issued Sept. 2, 1969, describes a motor-driven cam which is connected to a platform mounted on a rocker shaft so as to cause the platform to oscillate about the rocker shaft, and thereby cause a paint container attached to the platform to become oscillated over an angular arc having the rocker shaft as its vertex. U.S. Pat. No. 1,908,561, issued May 9, 1933, describes a paint shaker wherein two containers are vibrated about an axis normal to the container axis. U.S. Pat. No. 3,388,895 issued June 18, 1968, describes an apparatus wherein two paint cans are connected via rods to a single eccentric driving mechanism having a counter weight and wherein the containers are respectively rocked about an axis normal to the container axis.

SUMMARY OF THE INVENTION

The present invention utilizes a circular drive motion obtained from a drive motor which is transformed into an eccentric oscillatory motion by a crank which is connected to the drive motor, on one end, and connected to a shaker plate on the other. At least two other cranks are connected between the shaker plate and a mounting plate, and a container housing is attached to the shaker plate, so as to cause the shaker plate and container housing to oscillate in an eccentric path about an axis. A liquid container, such as a paint container, when placed in the container housing, experiences a shaking action to mix the liquid therein.

BRIEF DESCRIPTION OF THE DRAWINGS

A preferred embodiment of the invention is described herein, with reference to the drawings, in which.

DESCRIPTION OF THE PREFERRED EMBODIMENT

Figure 1:
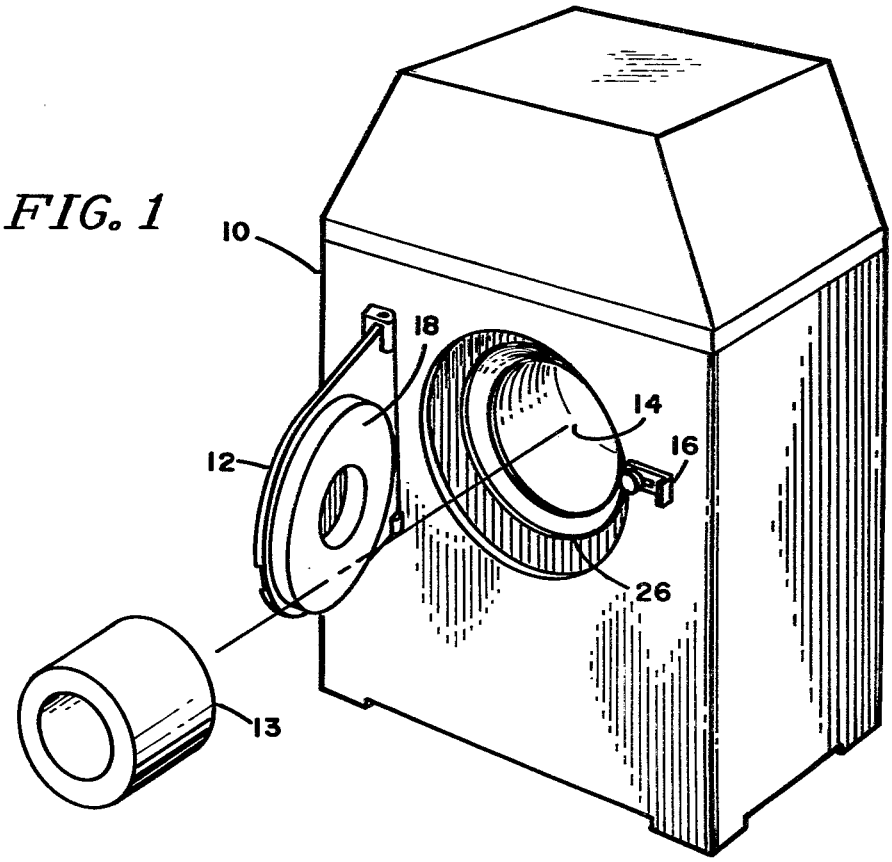
FIG. 1 is an isometric view of the invention.

Referring first to FIG. 1, the invention is shown in isometric view, comprising a paint mixer 10 with a suitable exterior cabinet housing the essential mechanical features. An opening 14 is formed in the front surface of paint mixer 10, which opening may be closed by a door 12. Door 12 has a cushion 18, preferably made from rubber or plastic material, sized to fit into opening 14. A container 13, which may for example be a one quart or one gallon paint container, is insertable through opening 14 into a container housing 27 inside the apparatus. When container 13 is placed inside the apparatus and door 12 is closed, cushion 18 prevents container 13 from moving forward against door 12 while the apparatus is operating. A shield 26 comprised of flexible rubber or plastic material is attached to the container housing and extends from the container housing to a point proximate the cushion 18. When door 12 is in its closed position it may be latched by latch 16. In the preferred embodiment an electrical switch (not shown) is activated by latch 16 so as to disable the electric drive motor to be hereinafter described whenever the door 12 is unlatched. This feature serves as a safety mechanism to prevent door 12 from being opened while the device is operating.

Figure 2:
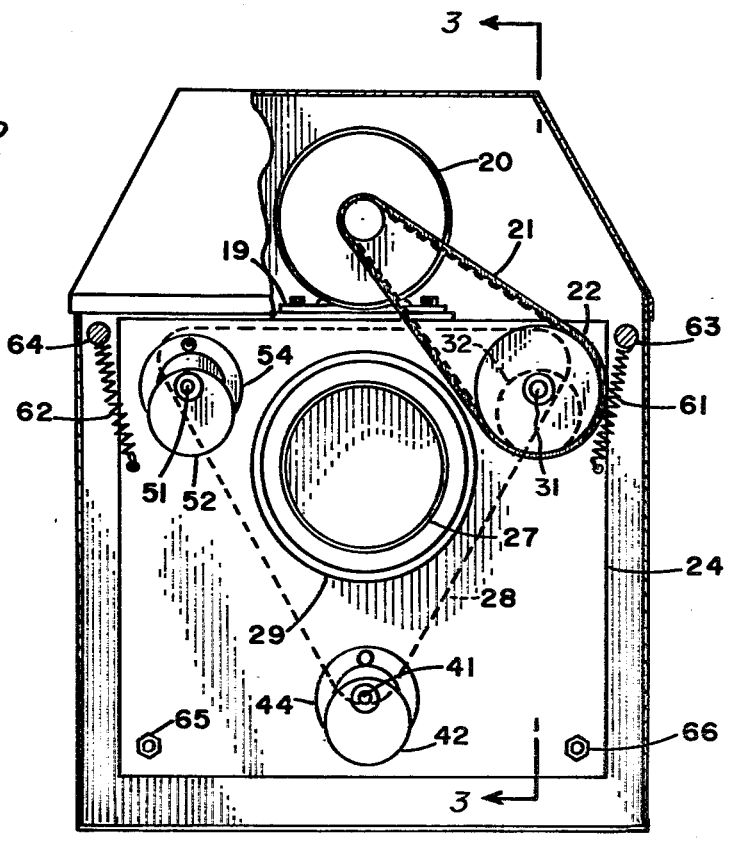
FIG. 2 is a front view of the invention with portions of the front cover removed for clarity.

FIG. 2 shows a front view of paint mixer 10 with portions of the front cabinet removed. An electric drive motor 20 is rigidly attached to the internal frame of the apparatus, and is coupled via a belt 21 to a drive pulley 22 which is affixed to a shaft 31. Shaft 31 is mounted on a bearing assembly 34 which is attached to a mounting plate 24. Electric motor 20 is a typical constant speed electric AC motor, preferably rated at about ½ horsepower.

A mounting plate 24 is suspended from frame members 63 and 64 by springs 61 and 62 respectively. Springs 61 and 62 permit freedom of vertical vibratory motion as the device operates, this motion being caused by the shaking effect of the container being oscillated over an eccentric path about an axis. Motor 20 is rigidly attached by means of a bolted or welded support base 19 to the upper edge of mounting plate 24, thereby permitting motor 20 to move in coincidence with mounting plate 24. Horizontal movement of mounting plate 24 is controlled by means of support rods pivotally attached to sockets 65 and 66.

Mounting plate 24 has a second shaft 41 attached thereto by means of bearing assembly 44, and a third shaft 51 attached thereto by means of bearing assembly 54. Each of these shafts, including shaft 31, has affixed thereto respective counterweights 32, 42 and 52. The rearward ends of each of these shafts are formed into respective eccentric crank arms and attached via a suitable bearing assembly to shaker plate 28, as will be more clearly seen with reference to FIG. 3. The counterweights 32, 42, 52 are positioned opposite the crank arm end offset so as to counter balance the vibratory motion created when shaker plate 28 is moved by the crank arms. All three crank arm ends of shafts 31, 41, 51 are displaced in the same relative direction with respect to one another.

Mounting plate 24 has an enlarged opening 29 through which container housing 27 may project. Container housing 27 is rigidly attached to shaker plate 28, and therefore follows the path of motion of shaker plate 28. The size of opening 29 is made larger than the maximum off-axis movement of container housing 27 so as to prevent container housing 27 from contacting the edge of opening 29 during operation.

Figure 3:
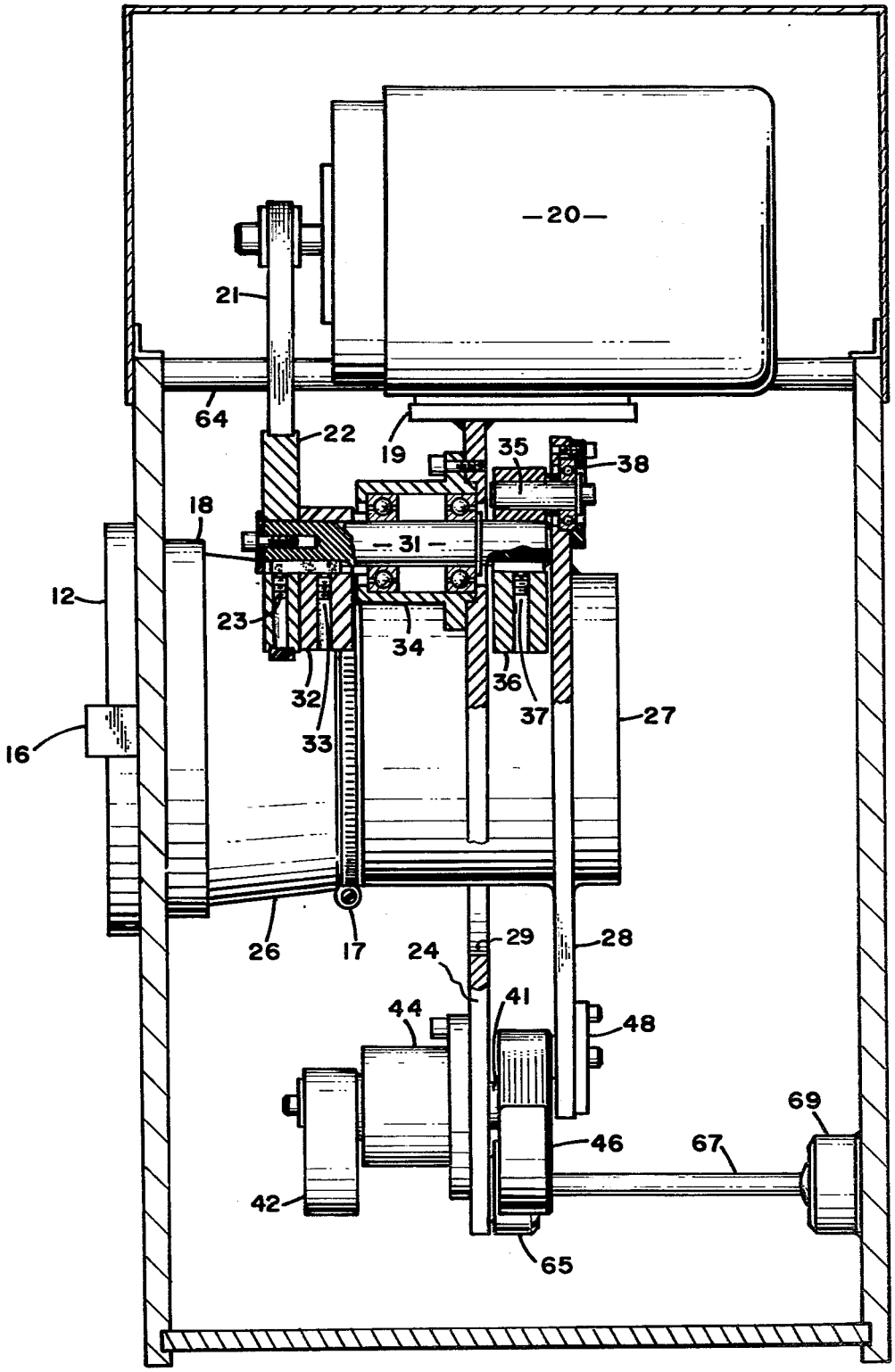
FIG. 3 is a side cross-sectional view taken along the lines 3—3 of FIG. 2.

FIG. 3 is a cross sectional view taken along the lines 3—3 of FIG. 2. Motor support base 19 is rigidly attached, preferably by means of welding, to mounting plate 24. The lower end of mounting plate 24 is horizontally stabilized in two positions corresponding to sockets 65 and 66. A rod 67 having a ball formed on each end is inserted into socket 65 at one end and socket 69 at the other end. Socket 65 is bolted to mounting plate 24 and socket 69 is bolted to the rear frame assembly. The ball and socket connections permit freedom of vertical movement of mounting plate 24, but prevent horizontal movement. Such control over movement of mounting plate 24 may also be accomplished with springs properly connected between the frame and mounting plate.

The respective connections and attachments to shaft 31 are shown in cross sectional view, it being understood that shaft 41 and 51 have similar connections and attachments. The only difference between shafts 31 and the other two shafts is in the attachment of pulley 22 to shaft 31, which pulley is not found on the remaining two shafts. Pulley 22 is attached via a lock screw 23 in a conventional manner. Counterweight 32 is attached to shaft 31 by means of lock screw 33. Shaft 31 is rotatably mounted in a bearing assembly 34 which is affixed to mounting plate 24. The other end of shaft 31 projects through mounting plate 24 and has a counterweight 36 attached to it by means of lock screw 37. A crank pin 35 is rigidly attached at a predetermined offset distance, preferably about two inches, from the axis of shaft 31. Pin 35 is coupled to shaker plate 28 by means of a suitable bearing assembly 38. It should be noted that counterweight 32 and counterweight 36 are diametrically offset from pin 35 so as to counterbalance the vibratory effects of shaker plate 28, container housing 27, and any container placed therein. Shafts 41 and 51 are similarly mechanically connected to the apparatus, with the net result that shaker plate 28 is attached via a three point triangular connection to the respective shafts.

Container housing 27 is a cylindrical housing which is rigidly attached to shaker plate 28, preferably by means of welding. Container housing 27 has a closed rear end and an open front end facing door 12. A clamp 17 secures a flexible shield member 26 around the perimeter of the open end of container housing 28. Flexible shield 26 extends proximate the facing surface of cushion 18 so as to close any opening or gap which might otherwise appear between the container housing and door 12 for safety reasons. Container housing 27 passes through the enlarged opening 29 in mounting plate 24 as has been hereinbefore described.

Figure 4:
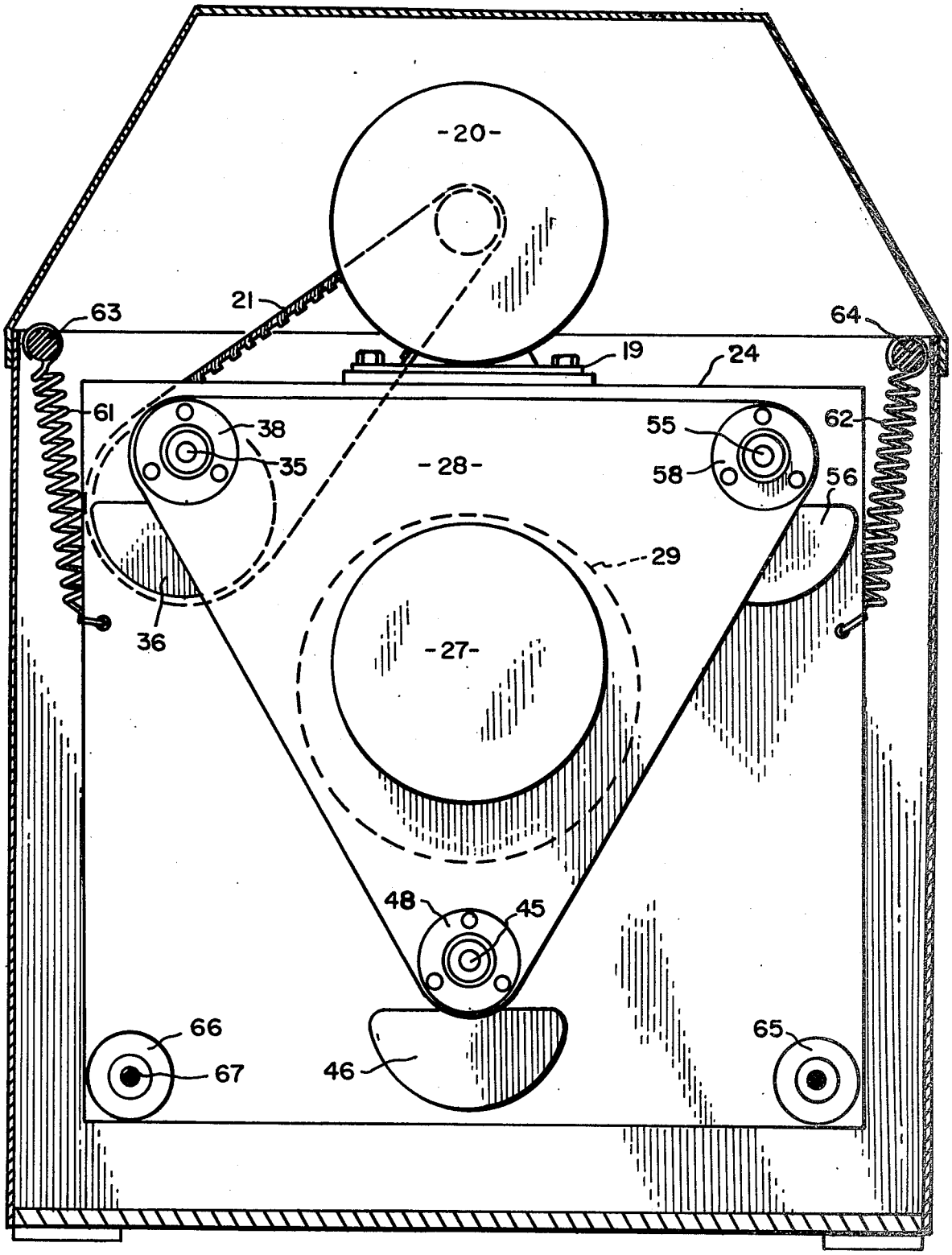
FIG. 4 is a rear view of the invention with the rear cover removed for clarity.

FIG. 4 shows the invention in rear view with the exterior cabinet removed for clarity. The triangular shaker plate 28 is connected to pins 35, 45 and 55 by means of bearing assemblies 38, 48 and 58 which are bolted to shaker plate 28. Counterweights 36, 46 and 56 are respectively attached to pins 35, 45 and 55 as has hereinbefore been described. Enlarged opening 29 in mounting plate 24 is positioned so as to permit container housing 27 to oscillate therethrough without contacting the interior edge of opening 29.

In operation, a suitable paint container is inserted into container housing 27 so that the paint container lies within the housing 27. Container housing 27 is designed to have a larger diameter than a standard one gallon paint container so as to permit the paint container to be easily inserted therein and to be capable of some ratational movement during operation. In the event a quart-size paint container is to be placed into container housing 27 a suitable sleeve may be constructed having an outer diameter so as to permit the sleeve to be snugly inserted into container housing 27 and having an inner diameter relatively larger than the paint container diameter to permit freedom of movement therein. Once the paint container has been placed in container housing 27 and door 12 is latched closed by latch 16, motor 20 may be energized by a suitable switch. Energization of motor 20 causes pulley 22 to rotate, thereby turning shaft 31 and oscillating shaker plate 28 via crank pin 35. Shafts 41 and 51 also rotate by virtue of the fact that shaker plate 28 is coupled at its triangular corners. Counterweights 32, 42, 52 and 36, 46, 56 are sized to provide a minimum vibration of mounting plate 24 as the apparatus operates.

Shaker plate 28 moves about an axis parallel with the axis of container housing 27, and circumscribes an eccentric path about this axis. It has been found that the oscillating motion created thereby causes a paint container lying within container housing 27 to slowly turn about its own axis as it moves with the container housing. Therefore, after only a few seconds of operation, the paint container turns itself completely about its own axis while being shaken about the eccentric path of oscillation of container housing 27. This additional turning motion causes any pigment or other solid material which may have settled within the paint container to be subjected to mixing forces from all rotational directions and greatly improves mixing quality of the apparatus.

An alternative construction utilizes a sleeve such as may be represented by 13 in FIG. 1, which sleeve 13 has an inside diameter for snugly fitting around a paint container without permitting relative rotational motion between sleeve and paint container. The outside diameter of sleeve 13 is sized to be smaller than the inside diameter of container housing 27, so as to permit the axial rotation described in the preceding paragraph to take place. However, in this construction it is sleeve 13 and the paint container together which slowly turn about their common axis while being shaken about the eccentric path of oscillation of container housing 27.

During operation, it has been observed that a turbulent zone of liquid develops within the container and remains relatively fixed in position above the container axis. A secondary effect has also been observed inside the container, and is believed to be caused by the relative rotation of the container about its axis as the container rotates within the container housing, even as the container housing is driven over an eccentric path. This secondary effect results when the heavier, unmixed material in the container tends to rotate with the container. In the case of a container filled with paint, the heavier material may be pigment or other paint component which tends to settle out of the liquid mixture when the container is left standing for a long period of time. As the container rotates, the heavier unmixed constituents of the mixture are brought into the relatively stationary turbulent zone and are subjected to the turbulence developed in this zone. This causes these heavier constituents to be violently agitated into mixture with the other liquids in the container. Since the container continuously rotates about its axis during the mixing operation it is ensured that all sediment, pigment or other heavy constituents will be subjected to the turbulent zone, to thereby provide complete and rapid mixing within the container.

A drive mechanism is selected to provide a rotational speed to shaker plate 28 of approximately 400–600 revolutions per minute. The respective crank pins are preferably designed so as to provide an off center eccentric of about 1–2 inches. With this combination it has been seen that a one gallon container of paint can be completely mixed in less than one minute. Further, the energy required to achieve complete mixing under the circumstances relating to this invention is greatly reduced from comparable prior art shaking mechanisms.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for mixing paint and the like in closed containers, comprising (a) a box-like frame assembly (b) a mounting plate vertically suspended from said frame assembly, said mounting plate having an enlarged hole therethrough and three bearing assemblies approximately equally spaced about said enlarged hole;

(c) a crankshaft passing through each of said bearing assemblies and through an aligned opening in said mounting plate;

(d) a drive pulley attached at one end of one of said crankshafts;

(e) rotary drive means attached to said mounting plate and coupled to said drive pulley in driving engagement; and (f) a shaker plate having respective bearing assemblies coupled to each of said crankshafts said shaker plate having rigidly attached thereto a cylindrical housing, said housing passing through said enlarged hole in said mounting plate.

2. The apparatus of claim 1, further comprising means for limiting horizontal motion of said mounting plate, coupled to said frame assembly.

3. The apparatus of claim 2, further comprising a door positioned adjacent said cylindrical housing and attached to said frame assembly, and means for extending the inner surface of said door into proximate contact with said cylindrical housing.

4. The apparatus of claim 3, further comprising counterweights attached to respective crankshafts.

5. The apparatus of claim 4, further comprising springs connected between said frame assembly and said mounting plate.

6. The apparatus of claim 5, wherein said cylindrical housing further comprises a cylinder of diameter greater than the diameter of said closed containers, a closed end on said cylinder, and an open end on said cylinder facing said door.

7. The apparatus of claim 6, wherein said crankshafts further comprise a crank offset ranging from one inch to three inches.

8. The apparatus of claim 7, further comprising a flexible shield member attached around the open end circumference of said cylinder and extending to proximate contact with said door inner surface.

9. An apparatus for mixing paint and the like in closed containers, comprising:

(a) a frame assembly;

(b) a mounting plate suspended vertically from said frame assembly, said mounting plate having a motor attached thereto and having an enlarged hole therethrough.

(c) a shaker plate mounted in spaced apart parallel relationship to said mounting plate by means of crankshafts coupled between said mounting plate and said shaker plate;

(d) a cylindrical container housing attached to said shaker plate and projecting through said mounting plate enlarged hole, said housing having an open end and a closed end; and (e) drive coupling means, attached to one of said crankshafts and coupled to said motor, for imparting rotational motion to said crankshaft and thereby cause said shaker plate to oscillate about an eccentric path.

10. The apparatus of claim 9, further comprising counterweights attached to said crankshafts in weighted balance with said shaker plate.

11. The apparatus of claim 10, further comprising at least two suspension springs connected between said frame assembly and said mounting plate.

12. The apparatus of claim 11, further comprising means for horizontally stabilizing said mounting plate, attached to said frame assembly.

13. The apparatus of claim 12, wherein said crankshafts comprise three crankshafts located at approximately 120° spacing about said enlarged mounting plate hole.

14. An apparatus for mixing paint and the like in closed containers, comprising (a) a frame assembly;

(b) a mounting plate vertically suspended from said frame assembly;

(c) a motor drive mechanism attached to said mounting plate;

(d) a plurality of shafts mounted on bearing assemblies attached to said mounting plate, said shafts having crank arms respectively formed on one end;

(e) a second plate attached to said shaft crank arms by means of bearing assemblies attached to said second plate, whereby said second plate is positioned in parallel spaced relation to said mounting plate;

(f) a cylindrical container housing attached to said second plate, said housing having an open end and a closed end;

(g) drive coupling means attached to at least one of said shafts for coupling to said motor drive mechanism; and (h) at least one counterweight attached to said shafts in weighted balance with said second plate.

15. A method of mixing liquids such as paint in a closed cylindrical container, comprising the steps of rotating said container about its own axis and simultaneously moving said container over a closed path in a plane which is normal to said container axis, said closed path being circumscribed about an axis which is parallel but not coincident with said container axis.

16. The method of claim 15, wherein said step of simultaneously moving said container over a closed path is further limited as a generally triangular closed path.

17. A method of mixing liquids such as paint in a closed cylindrical container by the simultaneous rotation of the container about its axis and movement of the container over a continuous path about a secondary axis, comprising the steps of:

(a) placing said container in a cylindrical housing having an axis which is parallel but not coincident with said container axis; and (b) moving said cylindrical housing over a closed path about an axis which is parallel but not coincident with said cylindrical housing axis.

18. The method of claim 17, wherein the step of moving said cylindrical housing over a closed path further comprises moving over said closed path at a rate of from 400 to 600 times per minute.

19. The method of claim 17, wherein the step of moving said cylindrical housing over a closed path about an axis further comprises moving over an eccentric path of from one to two inches deviation from the axis of said path.

* * * * *